US007524120B2

(12) United States Patent
Minoya et al.

(10) Patent No.: US 7,524,120 B2
(45) Date of Patent: Apr. 28, 2009

(54) TAPE PRINTER

(75) Inventors: Tsuyoshi Minoya, Nagoya (JP); Toshihiro Takahashi, Nagoya (JP); Yuji Sakano, Toyota (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 375 days.

(21) Appl. No.: 11/314,360

(22) Filed: Dec. 22, 2005

(65) Prior Publication Data

US 2006/0216100 A1 Sep. 28, 2006

(30) Foreign Application Priority Data

Dec. 27, 2004 (JP) ..... 2004-375410

(51) Int. Cl.
*B41J 11/70* (2006.01)
*B41J 15/00* (2006.01)
*B41J 3/36* (2006.01)

(52) U.S. Cl. ..... 400/619; 400/613; 400/663

(58) Field of Classification Search ..... 400/613, 400/691

See application file for complete search history.

(56) References Cited

U.S. PATENT DOCUMENTS 5,120,147 A 6/1992 Ozaki
5,839,840 A 11/1998 Kawano
6,113,292 A * 9/2000 Unno et al. ..... 400/578

FOREIGN PATENT DOCUMENTS

EP 0 832 753 A1 4/1998
JP A 7-290802 11/1995
JP A 10-100494 4/1998

* cited by examiner

*Primary Examiner*—Daniel J Colilla
*Assistant Examiner*—Marissa L Ferguson-Samreth
(74) *Attorney, Agent, or Firm*—Oliff & Berridge, PLC

(57) ABSTRACT

A tape printer capable of separating a print head and a platen when the print head and the platen adhere to each other while the tape printer is stored with a tape cassette uninstalled, keeping a holding member at a pressing position. A cassette cover has a pressing cam part which comes into contact with a roller holder to press the roller holder to a pressing position in a closed state of the cassette cover, and a withdrawing cam part which presses a withdrawing cam receiver to return the roller holder to a withdrawing position in the process of shifting from the closed state to an opened state of the cassette cover. Accordingly, the withdrawing cam part forces the withdrawing cam receiver provided in the roller holder, so that the thermal head and the platen roller which have adhered to each other can be surely separated even after the tape printer is stored for a long period with the tape cassette uninstalled, keeping the roller holder at the pressing position.

4 Claims, 7 Drawing Sheets

TAPE PRINTER

TECHNICAL FIELD

The disclosure relates to a tape printer, especially to the enhanced-usability tape printer in which a cassette cover performs a separation between a print head and a platen roller when the print head and the platen roller adhere to each other while the tape printer is stored with a tape cassette uninstalled.

BACKGROUND

Conventionally, various tape printers, which can print on a print tape of a long printing medium, displaying a text composed of characters inputted with input means such as a keyboard, have been suggested. In the tape printer, the print tape is generally supplied from a tape cassette in which the print tape, an ink ribbon, and a release paper are wound on each spool and housed in a predetermined-shape cassette.

In a tape cassette housing part of the tape printer, there are provided with a print head for printing on the tape and a platen for feeding the tape. In printing, the print tape is pressed against the print head by the platen to be printed the text, and discharged as a printed tape. Herein, when the tape cassette is to be removed for replacement, the print head and the platen need to move away from a pressing position of the print tape in order to release pressure exerted on the print tape by the print head and the platen. Accordingly, at least one of the print head and the platen is made movable, and a release member is provided to move the print head or the platen between the pressing position and a withdrawing position. Further, a cassette cover for covering the tape cassette installed in the tape cassette housing part is also provided. In printing, the cassette cover is closed to prevent an entry of something extraneous from outside.

Japanese Patent Application laid-open No. H10(1998)-100494 discloses, as the release member described above, an engagement portion provided in the cassette cover for moving a platen holder (the platen) in the pressing position when the cassette cover is closed, and an elastic member for moving the platen holder (the platen) to the withdrawing position when the cassette cover is opened.

However, in the tape printer of the above publication, there is a risk that, while the tape printer is stored for a long period without the tape cassette, keeping the platen holder at the pressing position, the print head and the platen adhere to each other, and they can no longer return to the withdrawing position with a force of repulsion. In case the repulsion of the elastic member is enhanced to solve the problem, this causes deformation of the platen, and the increase in cost since each part also needs to be reinforced.

SUMMARY

The disclosure has been made in view of the above circumstances and has an object to overcome the above problems and to provide a tape printer provided with a cassette cover which is openable and closable, including a pressing cam part to press a holding member to a pressing position in an closed state of the cassette cover and a withdrawing cam part to return the holding member to a withdrawing position in a process of shifting to an opened state of the cassette cover, so that a print head and a platen which have adhered to each other can be surely separated even after the tape printer is stored for a long period with a tape cassette uninstalled, keeping the holding member at the pressing position.

To achieve the purpose of the invention, there is provided a tape printer comprising: a cassette holding part for holding a removable tape cassette which houses a print tape therein; a print head for printing on the print tape; a platen roller for pressing the print tape against the print head; a holding member for holding either one of the platen roller and the print head, the holding member being movable between a pressing position in which the platen roller and the print head are pressed against each other and a withdrawing position in which the platen roller and the print head are separated from each other; and a cassette cover capable of opening and closing for covering the tape cassette installed in the cassette holding member; wherein the cassette cover has a pressing operation device which contacts the holding member and presses the holding member to the pressing position during a closed state of the cassette cover, and a withdrawing operation device which contacts the holding member and returns the holding member to the withdrawing position during a transitional period from an opened state to the closed state of the cassette cover.

In the tape printer of the first aspect, especially, the cassette cover has the pressing operation device which comes into contact with the holding member to press the holding member to the pressing position in the closed state of the cover, and the withdrawing operation device which comes into contact with the holding member to return the holding member to the withdrawing position in the process of shifting from the closed state to the opened state of the cassette cover. Accordingly, the withdrawing operation device forces the holding member to return to the withdrawing position, so that the print head and the platen roller which have adhered to each other can be surely separated even after the tape printer is stored for a long period with the tape cassette uninstalled, keeping the holding member at the pressing position.

DETAILED DESCRIPTION

Figure 1:
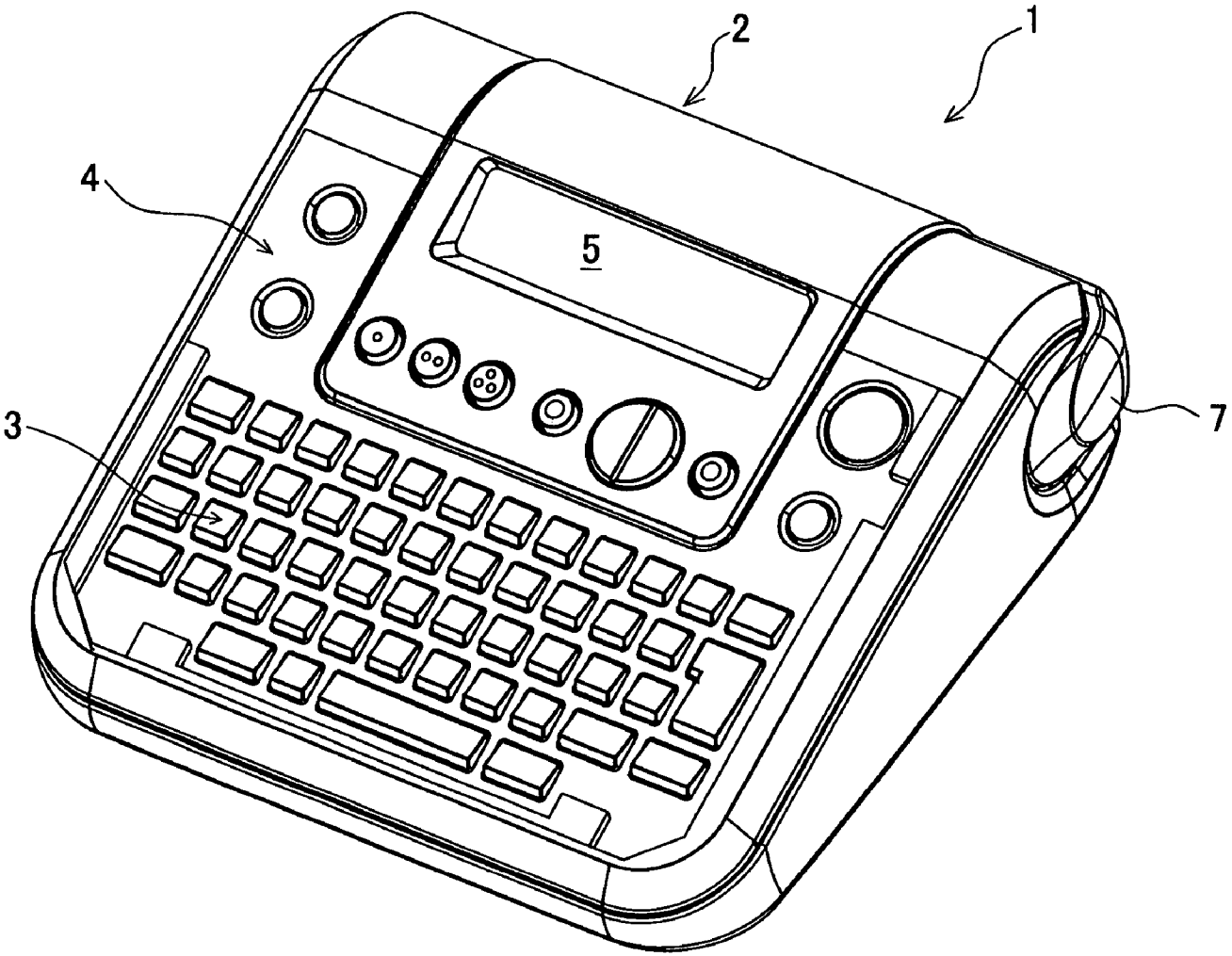
FIG. 1 is an external perspective view of a tape printer of a first exemplary embodiment.
Figure 2:
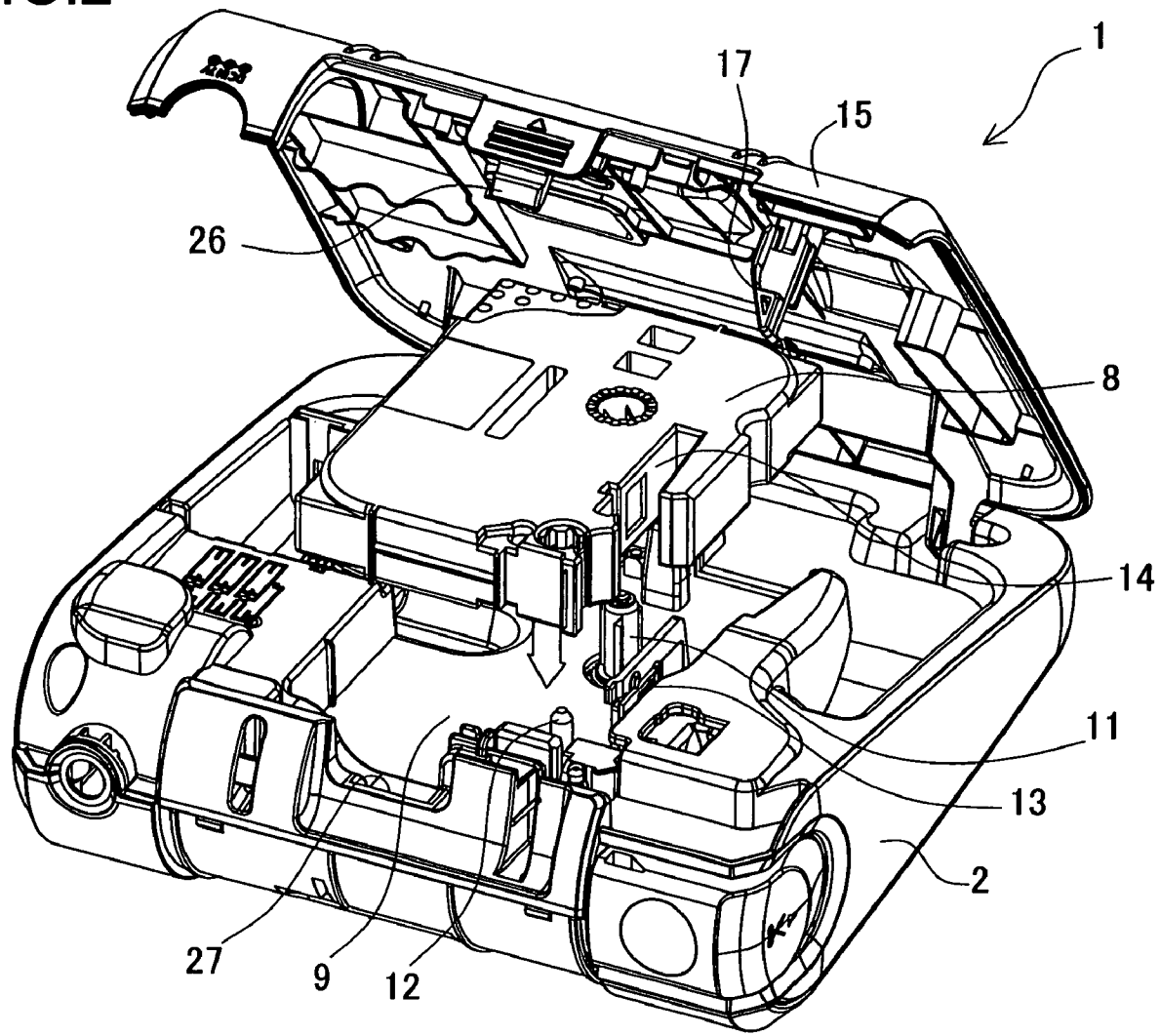
FIG. 2 is a perspective view of the tape printer in which a cassette cover is open, seen from a backward direction.
Figure 3:
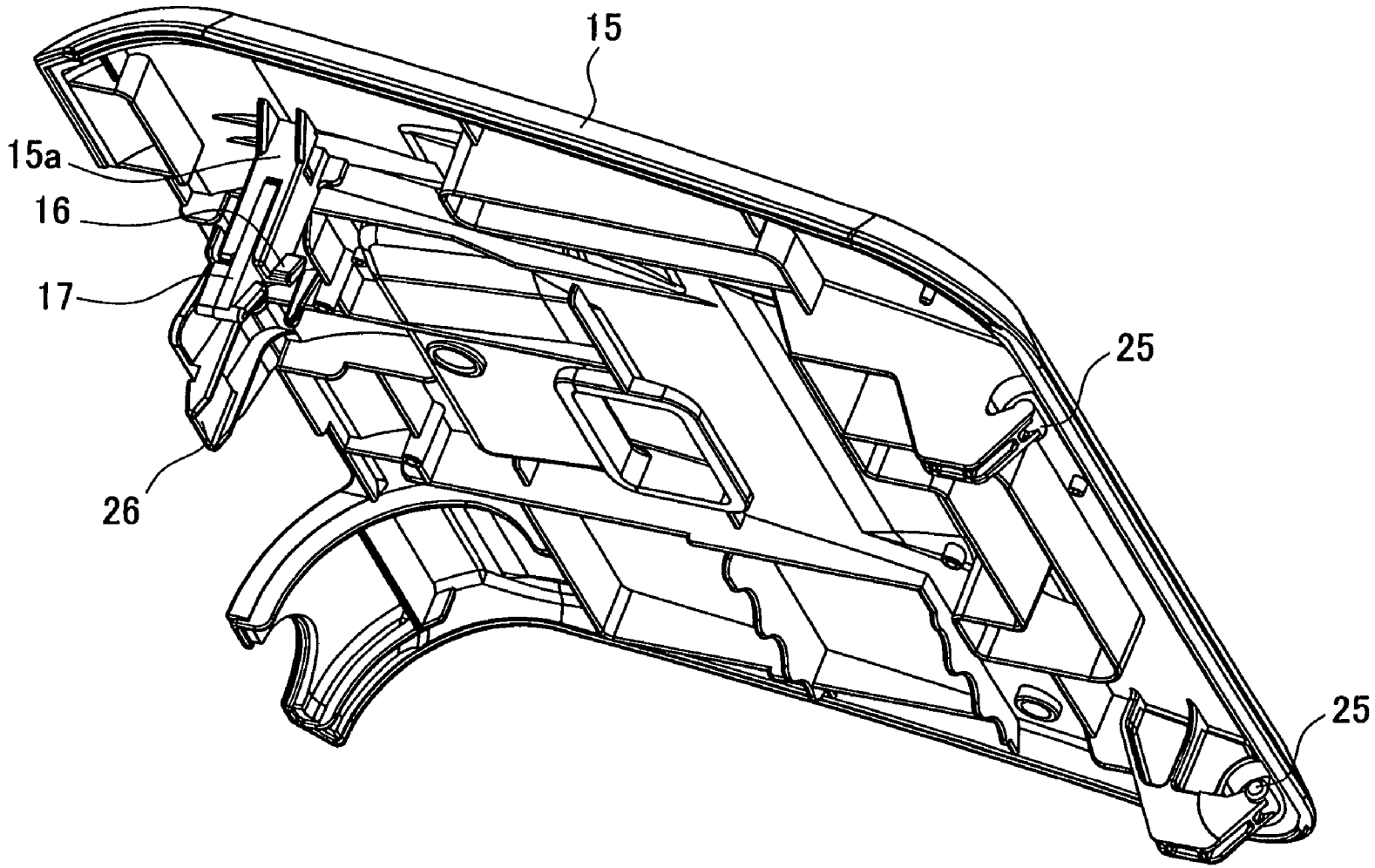
FIG. 3 is a perspective view of a tape cassette, seen from below.
Figure 4:
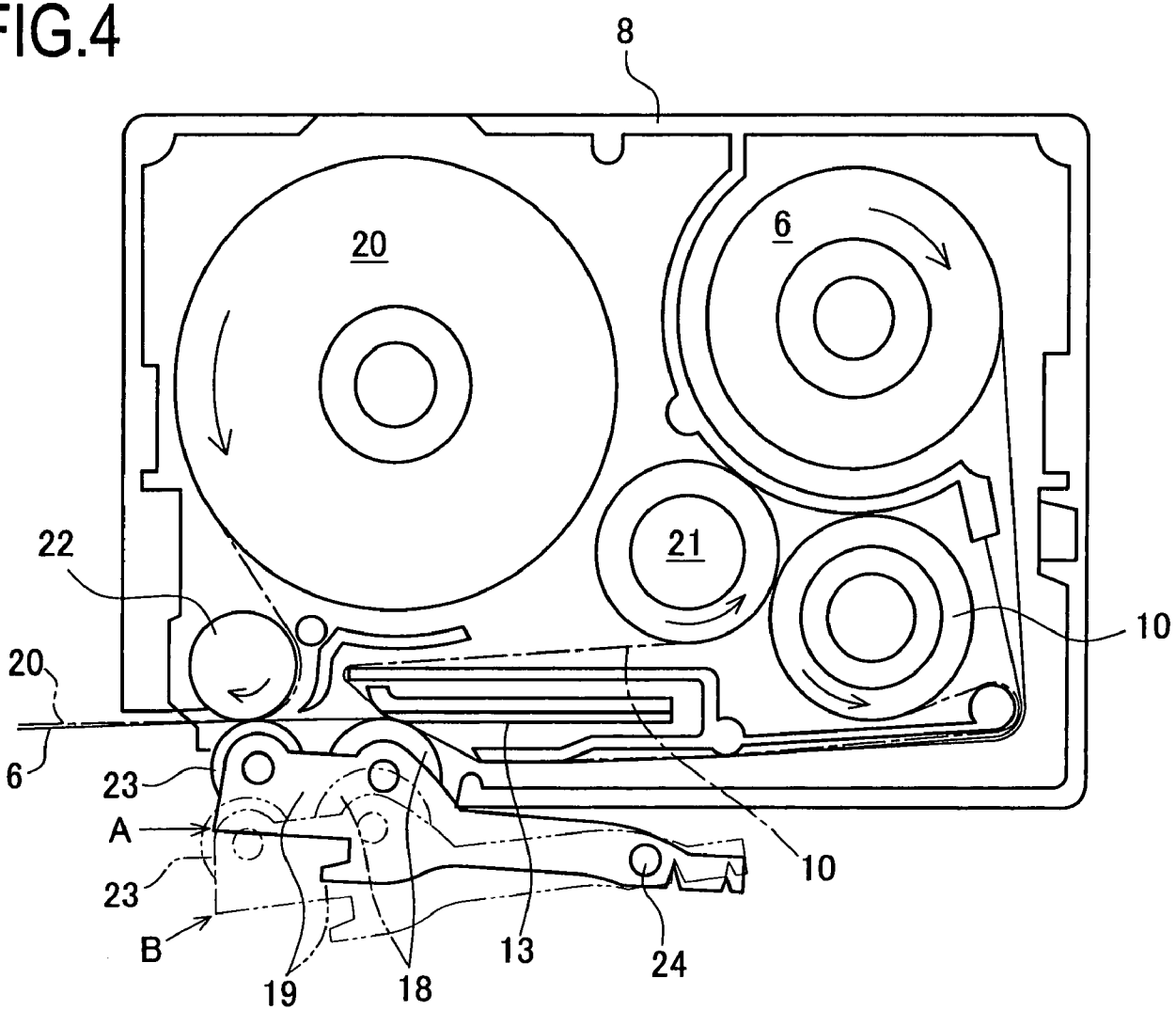
FIG. 4 is an explanatory view of an inner structure of the tape cassette and a print part.

A detailed description of a first exemplary embodiment of a tape printer will now be given referring to the accompanying drawings. Firstly, a schematic structure of the tape printer in the first exemplary embodiment will be explained with reference to FIGS. 1 to 4. FIG. 1 is an external perspective view of the tape printer. FIG. 2 is a perspective view of the tape printer in which a cassette cover is open, seen from a backward direction. FIG. 3 is a perspective view of a tape cassette, seen from below. FIG. 4 is an explanatory view of an inner structure of the tape cassette and a print part.

As shown in FIG. 1, a tape printer 1 of the first exemplary embodiment is provided with a keyboard 3, function keys 4, a liquid crystal display (LCD) 5, and a cutter lever 7. The keyboard 3, with which various kinds of characters are entered, is placed on a top face of a main body 2. Above the keyboard 3, there is provided the function keys 4 including a power switch and a print key for controlling the tape printer 1, and the LCD 5 for displaying the entered characters and symbols. The cutter lever 7 is provided at the upper right corner of the tape printer 1 for cutting a print tape 6.

As shown in FIG. 2, a cassette holding part 9 is formed in a rear of a back face of the main body 2 (on the front side in FIG. 2) to hold a tape cassette 8 which houses the print tape 6 in a cassette case of a predetermined shape therein. In the cassette holding part 9, there are provided a ribbon take-up cam 11 for taking up a spent ink ribbon 10 in the tape cassette 8, and a tape feed roller cam 12 for feeding the printed print tape 6. Additionally, a thermal head 13 (corresponding to a print head) for printing on the print tape is also arranged in the cassette holding part 9 so as to fit into an opening portion 14 of the tape cassette 8 when the tape cassette 8 is set in the cassette holding part 9.

The cassette holding part 9 is covered with a cassette cover 15 which is able to open and close. The cassette cover 15 has a withdrawing cam part 16 which is integrally formed with an extended portion 15*a* extended downward from the cassette cover 15, and a pressing cam part 17 (see FIG. 3) which is attached to the extended portion 15*a*. Also in the cassette holding part 9, there is provided a roller holder 19 (corresponding to a holding member) which is holding a platen roller 18, and able to pivot between a pressing position A (see FIG. 4) wherein the platen roller 18 is pressed against the thermal head 13, and a withdrawing position B (see FIG. 4) wherein the platen roller 18 is separated from the thermal head 13.

An inner structure of the tape cassette 8 is shown in FIG. 4, taking a laminated-tape cassette as an example. For explanation, FIG. 4 includes parts such as the thermal head 13 and the roller holder 19, which constitute a print mechanism of the tape printer 1 in corporation with the inner structure of the tape cassette 8 and placed in the cassette holding part 9.

The tape cassette 8 houses the print tape 6, the ink ribbon 10, and an adhesive tape 20, which are wound around supply spools each of which is placed turnably. The print tape 6 of a predetermined width is made of a transparent film. The ink ribbon 10 is applied ink on a front face thereof, to be transferred to the print tape 6. The adhesive tape 20 of the same width as the print tape 6 is adhered to the back face of the printed print tape 6. Surrounded by the print tape 6, the ink ribbon 10, and the adhesive tape 20, a spent ink ribbon take-up spool 21 is placed to take up the ink ribbon 10 which is spent for printing. Inside the tape cassette 8 near the opening portion 14, a tape feed roller 22 is provided to discharge the printed print tape 6 to the outside of the tape cassette 8, and to stick the adhesive tape 20 on the back face of the printed print tape 6.

When the tape cassette 8 is set into the cassette holding part 9 of the tape printer 1, the ribbon take-up cam 11 and the tape feed roller cam 12 in the cassette holding part 9 are fit into the spent ink ribbon take-up spool 21 and tape feed roller 22 in the tape cassette 8 respectively. In printing, the spent ink ribbon take-up spool 21 and the tape feed roller 22 in the tape cassette 8 are driven and rotated. Accordingly, the print tape 6 and the ink ribbon 10 are unwound from each supply spool, overlapped each other, and fed to the thermal head 13 whereby performing a predetermined printing operation. After that, the spent ink ribbon 10 is separated from the printed print tape 6, and wound on the spent ink ribbon take-up spool 21. The printed print tape 6 is adhered to the supplied adhesive tape 20, and discharged outward with the tape feed roller 22.

Next, a structure for pressing the print tape 6 against the thermal head 13 in printing will be explained. As mentioned above, the thermal head 13 provided in the cassette holding part 9 as in FIG. 2 is arranged to fit into the opening portion 14 of the tape cassette 8 when the tape cassette 8 is installed. The platen roller 18 is placed in the opposite side to the thermal head 13, interposing the print tape 6 therebetween. A pressing roller 23 is placed facing the tape feed roller 22 of the tape cassette 8. The platen roller 18 and the pressing roller 23 are rotatably attached to the roller holder 19 which is turnably mounted on a holder shaft 24. As the roller holder 19 pivots, the platen roller 18 and the pressing roller 23 are held in either the pressing position A (indicated with a solid line) wherein the platen roller 18 is pressed against the thermal head 13, or the withdrawing position B (indicated with a two-dotted chain line) wherein the platen roller 18 is moved away from the thermal head 13.

Figure 5B:
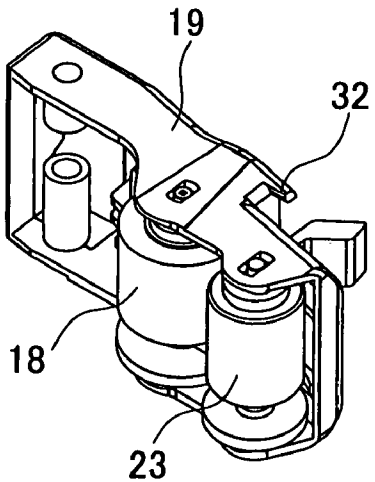
FIG. 5B is a perspective view of a roller holder of the print mechanism, seen from the opposite side.
Figure 5A:
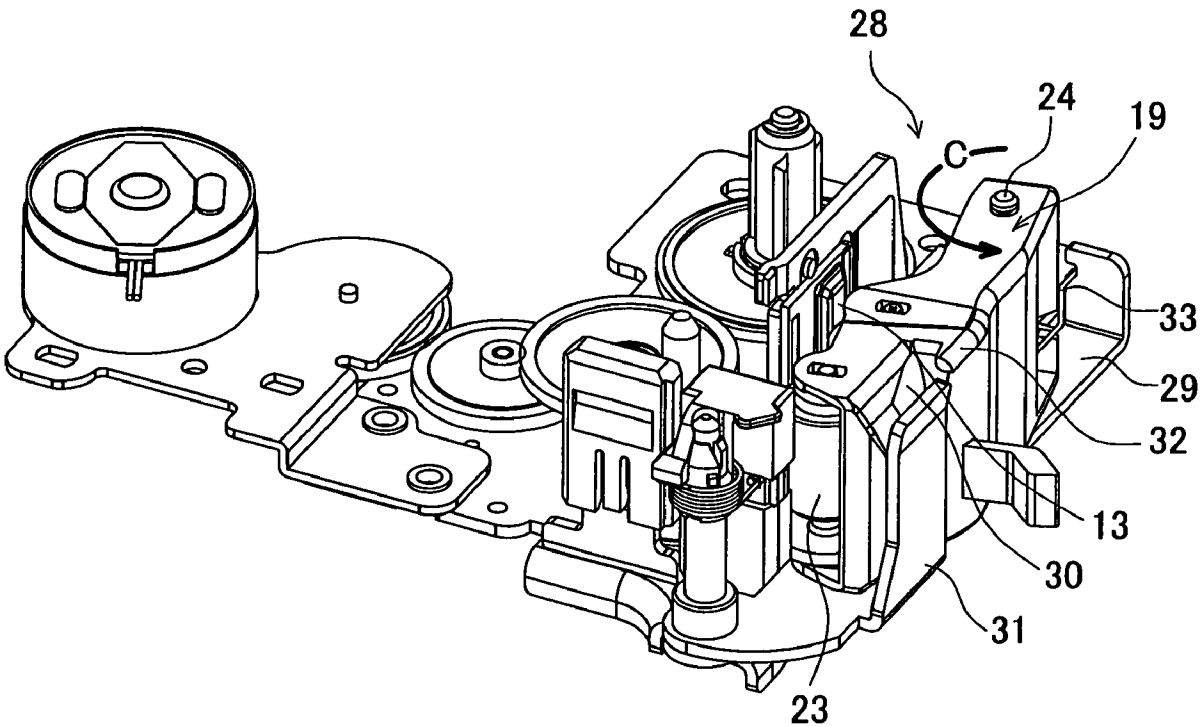
FIG. 5A is a perspective view of a whole appearance of a print mechanism.
Figure 6A:
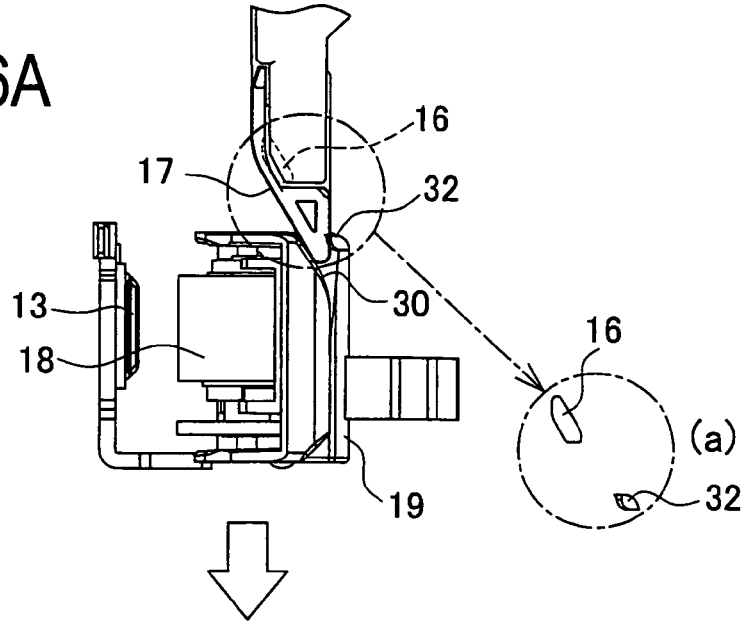
FIG. 6A is an explanatory view of a relationship between pressing and withdrawing cam parts and the roller holder in a cover closed state, showing a state in which the pressing cam part starts to come in contact with a pressing cam receiver.
Figure 6B:
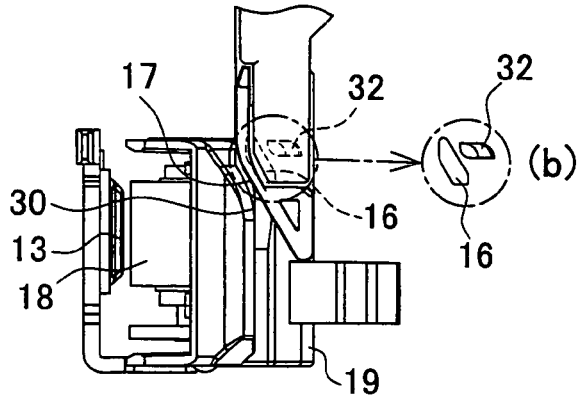
FIG. 6B is an explanatory view of the relationship between the pressing and withdrawing cam parts and the roller holder when the cassette cover is closed, showing a state in which the pressing cam part further contacts the pressing cam receiver, and the platen roller and the thermal head nearly contact each other.
Figure 6C:
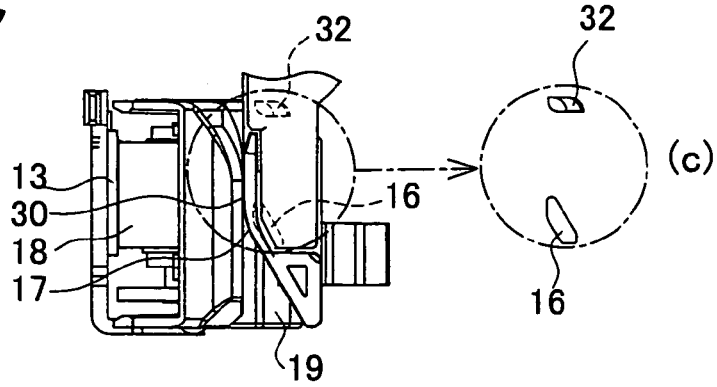
FIG. 6C is an explanatory view of a relationship between the pressing and withdrawing cam parts and the roller holder when the cassette cover is closed, showing a state in which the pressing cam part is wholly in contact with the pressing cam receiver, and the platen roller and the thermal head has contacted each other.
Figure 7A:
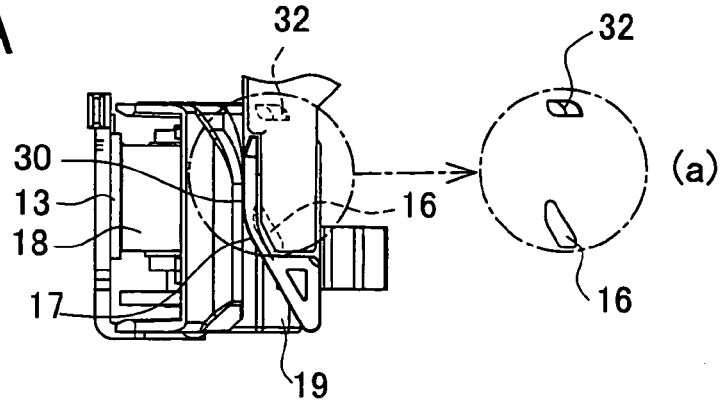
FIG. 7A is an explanatory view of a relationship between the pressing and withdrawing cam parts and the roller holder when the thermal head is in contact with the platen roller, showing a state in which the pressing cam part has wholly contacted the pressing cam receiver, and the platen roller and the thermal head are in contact with each other.
Figure 7B:
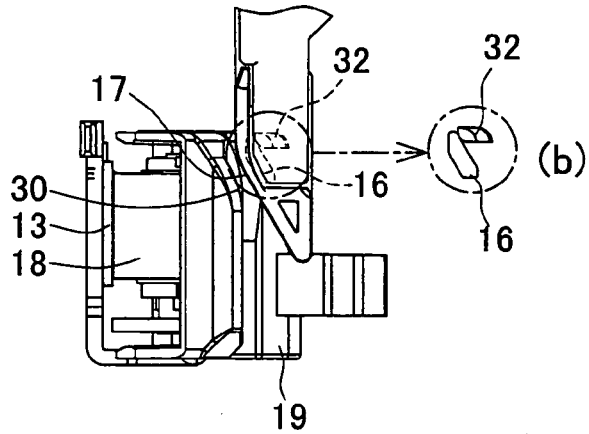
FIG. 7B is an explanatory view of a relationship between the pressing and withdrawing cam parts and the roller holder when the thermal head is in contact with the platen roller, showing a state in which the pressing cam part is pulled up, and the withdrawing cam part starts to come in contact with the withdrawing cam receiver, and the platen roller and the thermal head are nearly separated from each other.
Figure 7C:
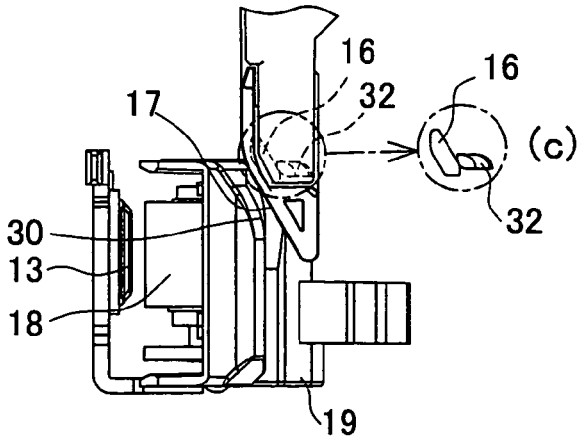
FIG. 7C is an explanatory view of a relationship between the pressing and withdrawing cam parts and the roller holder when the cassette cover is opened, showing a state in which the withdrawing cam part and the withdrawing cam receiver further contacts each other, and the platen roller and the thermal head are completely separated from each other.

Next, a mechanism for pressing and releasing the platen roller 18 and a pressing roller 23 by opening and closing the cassette cover 15 covering the cassette holding part 9 will be explained referring to FIGS. 2, 3, and 5A through 7C. FIG. 5A is a perspective view of a whole appearance of the print mechanism. FIG. 5B is a perspective view of the roller holder of the print mechanism, seen from the opposite side. FIG. 6A is an explanatory view of a relationship between the pressing and withdrawing cam parts and the roller holder when the cassette cover is closed, showing a state in which the pressing cam part starts to come in contact with a pressing cam receiver. FIG. 6B is an explanatory view of the relationship between the pressing and withdrawing cam parts and the roller holder when the cassette cover is closed, showing a state in which the pressing cam part further contacts the pressing cam receiver, and the platen roller and the thermal head nearly contacts each other. FIG. 6C is an explanatory view of a relationship between the pressing and withdrawing cam parts and the roller holder when the cassette cover is closed, showing a state in which the pressing cam part is wholly in contact with the pressing cam receiver, and the platen roller and the thermal head has contacted each other. FIG. 7A is an explanatory view of a relationship between the pressing and withdrawing cam parts and the roller holder when the thermal head is in contact with the platen roller, showing a state in which the pressing cam part has wholly contacted the pressing cam receiver, and the platen roller and the thermal head are in contact with each other. FIG. 7B is an explanatory view of a relationship between the pressing and withdrawing cam parts and the roller holder when the thermal head is in contact with the platen roller, showing a state in which the pressing cam part is pulled up, and the withdrawing cam part starts to come in contact with the withdrawing cam receiver, and the platen roller and the thermal head are nearly separated from each other. FIG. 7C is an explanatory view of a relationship between the pressing and withdrawing cam parts and the roller holder when the cassette cover is opened, showing a state in which the withdrawing cam part and the withdrawing cam receiver further contacts each other, and the platen roller and the thermal head are completely separated from each other.

The cassette cover 15 being able to open and close, as shown in FIGS. 2 and 3, covers the cassette holding part 9, and is attached to the main body 2 of the tape printer 1 with hinge parts 25, 25. The cassette cover 15 is opened and closed the cassette holding part 9 by pivoting about the hinge parts 25, 25 as shown in FIG. 3. An engagement hook 26 is provided at the edge of the cassette cover 15. The engagement hook 26 is engaged with an engagement part 27 which is provided in the main body 2 of the tape printer 1 to keep the cassette cover 15 closed. The engagement hook 26 is elastic, so that it is disengaged by an operator's predetermined operation, thereby opening the cassette cover 15.

A print mechanism 28 shown in FIGS. 5A and 5B is arranged in the cassette holding part 9 covered with the cassette cover 15. In the print mechanism 28 of the tape printer 1, the roller holder 19 holding the platen roller 18 and the pressing roller 23 is turnably attached to a frame 29 which is fixed in the tape printer 1. The holder shaft 24 is fixed on the frame 29, and the roller holder 19 is turnable about the holder shaft 24, as mentioned above. When the roller holder 19 pivots along an arrow C in FIG. 5A, it moves to the withdrawing position B (see FIG. 4). At the same time, the platen roller 18 and the pressing roller 23 are separated from the thermal head 13 and the tape feed roller 22 (see FIG. 4) respectively. When the roller holder 19 pivots reversely along the arrow C, it moves to the pressing position A (see FIG. 4). At this time, the platen roller 18 and the pressing roller 23 are pressed against the thermal head 13 and the tape feed roller 22 respectively, interposing the print tape 6 of the tape cassette 8 (see FIG. 4) between them.

In the roller holder 19, there is formed a pressing cam receiver 30 with which the pressing cam part 17 provided in the extended portion 15*a* extended from the cassette cover 15 described later is slidably in contact. On the frame 29, an auxiliary pressing frame 31 is provided upright to prevent the pressing cam part 17 from withdrawing when the pressing cam part 17 presses the pressing cam receiver 30.

Furthermore, a withdrawing cam receiver 32 is formed in the roller holder 19. The withdrawing cam part 16 which is integrally formed with the extended portion 15*a* extended from the cassette cover 15 described later comes slidably in contact with the withdrawing cam receiver 32 when the cassette cover 15 is opened. In the frame 29, a toggle spring 33 is attached to the holder shaft 24 to keep the roller holder 19 toward the direction of the withdrawing position B.

Herein, referring to FIGS. 6A through 7C, explanations are made on the operation of the pressing cam part 17 provided in the extended portion 15*a* of the cassette cover 15 and the pressing cam receiver 30 of the roller holder 19, the withdrawing cam part 16 integrally formed with the extended portion 15*a* extended from the cassette cover 15 and the withdrawing cam receiver 32 of the roller holder 19, which are corresponding to opening and closing movement of the cassette cover 15.

Firstly, referring to FIGS. 6A through 6C, the operation when the cassette cover 15 is closed will be described. As shown in FIG. 6A, as the cassette cover 15 is closed, the pressing cam part 17 provided in the extended portion 15*a* extended from the cassette cover 15 comes into contact with the pressing cam receiver 30 of the roller holder 19. Then, the pressing cam part 17 moves the roller holder 19, which is kept in the withdrawing position B (see FIG. 4) by the force of the toggle spring 33, to the thermal head 13 side (on the left side in FIG. 6A) against the force. At that time, the withdrawing cam part 16 and the withdrawing cam receiver 32 are placed in noncontact relation.

Next, in FIG. 6B, the cassette cover 15 is further closed. The pressing cam part 17 provided in the extended portion 15*a* extended from the cassette cover 15 further contacts the pressing cam receiver 30 of the roller holder 19, and the thermal head 13 and the platen roller 18 nearly contacts each other. The withdrawing cam part 16 and the withdrawing cam receiver 32 are not in contact with each other, but they are side-by-side.

In FIG. 6C, the cassette cover 15 has completely closed. A perpendicular part of the pressing cam part 17 provided in the extended portion 15*a* extended from the cassette cover 15 comes into contact with the perpendicular part of the pressing cam receiver 30 of the roller holder 19. The thermal head 13 and the platen roller 18 are wholly in contact, and moved to the pressing position A (see FIG. 4). In the figure, the tape cassette 8 is not set. If the tape cassette 8 is installed, the print tape 6 and the ink ribbon 10 would be interposed between the thermal head 13 and the platen roller 18. Furthermore, the auxiliary pressing frame 31 (see FIG. 5A) prevents an end opposite to the pressing cam part 17 (on the right side in the figures) from being deformed with the pressure of the pressing cam part 17 which presses the platen roller 18 to the thermal head 13 against the force of the toggle spring 33. At the same time, the withdrawing cam part 16 and the withdrawing cam receiver 32 as shown in FIG. 6C are not in contact, but positioned above and below. If the tape cassette 8 is installed in this step, printing on the tape can be performed.

Next, referring to FIGS. 7A through 7C, the operation to open the cassette cover 15 will be described. The cassette cover 15 starts to open from the state as shown in FIG. 7A, which is same as FIG. 6C.

As shown in FIG. 7B, when the cassette cover 15 starts to open, the perpendicular part of the pressing cam part 17 provided in the extended portion 15*a* extended from the cassette cover 15 becomes apart from the perpendicular part of the pressing cam receiver 30 of the roller holder 19. Then, the thermal head 13 usually begins to be separated from the platen roller 18 with the force of the toggle spring 33. However, the thermal head 13 has sometimes adhered to the platen roller 18 against the force of the toggle spring 33 while the tape printer 1 is stored for a long period with the tape cassette 8 uninstalled. In such a case, the withdrawing cam part 16 as shown in FIG. 7B comes into contact with the withdrawing cam receiver 32 to start to move the roller holder 19 toward the side opposite to the thermal head 13 (on the right side of the figures).

Then, as shown in FIG. 7C, the withdrawing cam part 16 continues to contact the withdrawing cam receiver 32 as the cassette cover 15 is further opened. At the same time, the roller holder 19 moves away from the thermal head 13. Accordingly, the platen roller 18 is completely separated from the thermal head 13. After that, the roller holder 19 returns to the withdrawing position B with the force of the toggle spring 33.

When the tape printer 1 comprising the print mechanism 28 is used, the tape cassette 8 is installed in the cassette holding part 9. Then, the cassette cover 15 is pressed down and closed as the engagement hook 26 is engaged with the engagement part 27 of the main body 2 of the tape printer 1. During these operations, the print mechanism 28 works as follows: As the cassette cover 15 is closed, the pressing cam receiver 30 of the roller holder 19 is pressed by the pressing cam part 17 provided in the extended portion 15*a* extended from the cassette cover 15. The roller holder 19 pivots reversely along the arrow C, and it moves to the pressing position A. Accordingly, when the cassette cover 15 is closed, the roller holder 19 always moves to the pressing position A, so that the tape printer 1 becomes capable of printing without any special operations.

To remove the tape cassette 8 after printing, the cassette cover 15 is opened without any special operations to release the engagement, only by being pressed around the engagement hook 26 of the cassette cover 15 directly. As the cassette cover 15 is opened, the pressing cam part 17 provided in the extended portion 15*a* extended from the cassette cover 15 is disengaged from the pressing cam receiver 30 of the roller holder 19, and the pressure on the roller holder 19 is released. With the force of the toggle spring 33, the roller holder 19 pivots along the arrow C, and moves to the withdrawing position B. In another case, the thermal head 13 has sometimes been adhered to the platen roller 18 against the force of the toggle spring 33 while the tape printer 1 is stored for a long period without the tape cassette 8. The withdrawing cam part 16 which is integrally formed with the extended portion 15*a* extended from the cassette cover 15 comes into contact with the withdrawing cam part 16 of the roller holder 19, in order to separate the platen roller 18 supported by the roller holder 19 from the thermal head 13. Therefore, the tape cassette 8 can be removed or installed as soon as the cassette cover 15 is opened. Specifically, only one action is effective in both installing the tape cassette 8 and removing it.

As described in detail above, the tape printer 1 of the first exemplary embodiment has the cassette holding part 9 for holding the tape cassette 8 which is removable and houses the print tape 6, the thermal head 13 for printing on the print tape 6, the platen roller 18 for pressing the print tape 6 against the thermal head 13, the roller holder 19 for holding the platen roller 18, and able to pivot between the pressing position A wherein the platen roller 18 and the thermal head 13 presses each other, and the withdrawing position B wherein the platen roller 18 and the thermal head 13 are separated from each other, and the cassette cover 15 being able to open and close for covering the tape cassette 8 held in the cassette holding part 9. The cassette cover 15 has the pressing cam part 17 for contacting and pressing the roller holder 19 to the pressing position A when the cassette cover 15 is closed, and the withdrawing cam part 16 for pressing the withdrawing cam receiver 32 provided in the roller holder 19 to return the roller holder 19 to the withdrawing position B during the process of the cassette cover 15 shifting from the closed state to the opened state. Accordingly, the thermal head 13 and the platen roller 18 which adhere to each other can be surely separated even after the tape printer 1 is stored for a long period with the tape cassette 8 uninstalled, keeping the roller holder 19 at the pressing position A.

In the tape printer 1 of the first exemplary embodiment, the extended portion 15*a* provided with the pressing cam part 17 and the withdrawing cam part 16 are integrally formed with the cassette cover 15, so that the high accuracy of the parts can be achieved. Also, the manufacturing cost can be considerably reduced since any adjustment is unnecessary for assembly, and numbers of the parts can be reduced to a minimum.

Next, a second exemplary embodiment will be explained. The tape printer of the second exemplary embodiment is almost same as the tape printer 1 of the first exemplary embodiment, but the structure of the pressing cam part 17 is partly different. As shown in FIG. 3, the pressing cam part 17 of the first exemplary embodiment is attached to the extended portion 15*a* extended from the cassette cover 15. In the second exemplary embodiment, the pressing cam part 17 is integrally formed with the extended portion 15*a*.

According to the second exemplary embodiment, the pressing cam part 17 is formed with the extended portion 15*a* extended from the cassette cover 15, so that the higher accuracy of the parts can be achieved. Also, the manufacturing cost can be considerably reduced since any adjustment is unnecessary for assembly, and numbers of the parts can be reduced to a minimum.

The disclosure may be embodied in other specific forms without departing from the essential characteristics thereof. For instance, in the first exemplary embodiment, the toggle spring 33 is used to return the roller holder 19 to the withdrawing position B. A projection may be provided in the frame 29 so as to latch the roller holder 19 just before it returns to the withdrawing position B. Additionally, the roller holder 19 may be returned to the withdrawing position B only with the withdrawing cam part 16 integrally formed with the extended portion 15*a* extended from the cassette cover 15, so that the toggle spring 33 can be removed, and the manufacturing cost can be reduced.

While the presently exemplary embodiment has been shown and described, it is to be understood that this disclosure is for the purpose of illustration and that various changes and modifications may be made without departing from the scope of the invention as set forth in the appended claims.

What is claimed is:

1. A tape printer comprising:

a cassette holding part for holding a removable tape cassette which houses a print tape therein;

a print head for printing on the print tape;

a platen roller for pressing the print tape against the print head;

a holding member for holding either one of the platen roller and the print head, the holding member being movable between a pressing position in which the platen roller and the print head are pressed against each other and a withdrawing position in which the platen roller and the print head are separated from each other; and a cassette cover capable of opening and closing for covering the tape cassette installed in the cassette holding member;

wherein the cassette cover has a pressing operation device which contacts the holding member and presses the holding member to the pressing position during a closed state of the cassette cover, and a withdrawing operation device which contacts the holding member and returns the holding member to the withdrawing position during a transitional period from the closed state to an opened state of the cassette cover, and wherein the withdrawing operation device is a withdrawing cam part that is integrally formed with an extended portion that extends down from the cassette cover and comes slidably in contact with a withdrawing cam receiver when the cassette cover is in an open position.

2. The tape printer according to claim 1, wherein the pressing operation device is a pressing cam part which contacts the holding member and presses the holding member against the pressing position during the closed state of the cassette cover.

3. The tape printer according to claim 2, wherein the pressing cam part is integrally formed with the cassette cover.

4. The tape printer according to claim 1, wherein the withdrawing cam part is integrally formed with the cassette cover.

* * * * *